US012662935B2

(12) United States Patent
Bonderover et al.

(10) Patent No.: US 12,662,935 B2
(45) Date of Patent: Jun. 23, 2026

(54) METHOD AND SYSTEM FOR FAST PULSE TELEMETRY

(71) Applicant: MS Directional, LLC, Conroe, TX (US)

(72) Inventors: Eitan Bonderover, Sugar Land, TX (US); Libo Yang, Katy, TX (US); Shyam B. Mehta, Missouri City, TX (US)

(73) Assignee: MS DIRECTIONAL, LLC, Conroe, TX (US)

( * ) Notice: Subject to any disclaimer, the term of this patent is extended or adjusted under 35 U.S.C. 154(b) by 0 days.

(21) Appl. No.: 18/783,747

(22) Filed: Jul. 25, 2024

(65) Prior Publication Data

US 2025/0314170 A1 Oct. 9, 2025

Related U.S. Application Data

(60) Provisional application No. 63/573,581, filed on Apr. 3, 2024.

(51) Int. Cl.
*E21B 47/20* (2012.01)

(52) U.S. Cl.
CPC ..... *E21B 47/20* (2020.05)

(58) Field of Classification Search
CPC ..... E21B 47/12; E21B 47/14; E21B 47/18; E21B 47/20; E21B 47/22; E21B 47/24
See application file for complete search history.

(56) References Cited

U.S. PATENT DOCUMENTS 7,203,242 B2 * 4/2007 Lu ..... H04B 14/04 375/243
8,350,715 B2 * 1/2013 Shearer ..... H04L 25/4902 340/853.3
10,619,479 B2 * 4/2020 Zhang ..... E21B 47/18
2017/0306755 A1 * 10/2017 Barak ..... E21B 34/06

* cited by examiner

*Primary Examiner* — Franklin D Balseca
(74) *Attorney, Agent, or Firm* — Jackson Walker L.L.P.

(57) ABSTRACT

The disclosure provides a method and system for multiple symbol-frames to encode and decode each symbol-frame code value in contrast to current schemes of encoding and decoding the symbol-frame code based on evaluating single symbol-frames code for each bitstream value. By evaluating multiple symbol-frames and their relationship to each other to encode and decode each symbol-frame code value, the relationship between the pulse width and symbol-frame width can be varied. The description of the exemplary embodiment maintains the same symbol-frame width with a much wider pulse and encoding and decoding multiple symbols-frames to achieve higher data rate telemetry while maintaining the integrity of a signal. The method and associated software to code and decode multiple symbol-frames and their relationship to each other has demonstrated multiples of increased speed that significantly increases the capability of telemetry communication.

22 Claims, 10 Drawing Sheets

| | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|
| 1 | | | | | | | | | | | | | | | | | | | | | | | | | | | | | | |
| 2 | | | | | | | | | | | | | | | | | | | | | | | | | | | | | | |
| 3 | PREV. CODE | LEAD CODE | LAG CODE | | | | | LEAD SYMBOL-FRAME 12-SLOTS | | | | | | | | | SLOTS BETWEEN PULSE | | | | | LAG SYMBOL-FRAME 12-SLOTS | | | | | | | | | |
| 4 | | | | | | | | | | | | | | | | | | | | | | | | | | | | | | |
| 5 | | | | | | | | | | | | | | | | | | | | | | | | | | | | | | |
| 6 | | | | | | | | | | | | | | | | | | | | | | | | | | | | | | |
| 7 | | | | | X | 7 | 6 | 5 | 4 | 3 | 2 | 1 | 0 | X | X | X | | X | 7 | 6 | 5 | 4 | 3 | 2 | 1 | 0 | X | X | X | |
| 8 | | | | | | | | | | | | | | | | | | | | | | | | | | | | | | |
| 9 | | | | | | | | | | | | | | | | | | | | | | | | | | | | | | |
| 10 | | 0 | 0 | | | | | | | | | p | p | p | p | | 8 | | | | | | | | p | p | p | p | | |
| 11 | | 0 | 1 | | | | | | | | | p | p | p | p | | 7 | | | | | | | p | p | p | p | | | |
| 12 | | 0 | 2 | | | | | | | | | p | p | p | p | | 6 | | | | | | p | p | p | p | | | | |
| 13 | | 0 | 3 | | | | | | | | | p | p | p | p | | 5 | | | | | p | p | p | p | | | | | |
| 14 | | 0 | 4 | | | | | | | | | p | p | p | p | | 4 | | | | p | p | p | p | | | | | | |
| 15 | 0 | 0 | 5 | | | | | | | | | p | p | p | p | | 3 | | | p | p | p | p | | | | | | | |
| 16 | 0 | -1 | -1 | | NO PULSE | | | | | | | | | | | | | NO PULSE | | | | | | | | | | | | |
| 17 | 1,.. 7 | 0 | 5 | | | | | | | | | p | p | p | p | | 3 | | | p | p | p | p | | | | | | | |
| 18 | 1,.. 7 | 5 | -1 | | | | p | p | p | p | | | | | | | | NO PULSE | | | | | | | | | | | | |
| 19 | | 0 | 6 | | | | | | | | | p | p | p | p | | 2 | | p | p | p | p | | | | | | | | |
| 20 | | 2 | -1 | | | | | | | p | p | p | p | | | | | NO PULSE | | | | | | | | | | | | |
| 21 | | 0 | 7 | | | | | | | | | p | p | p | p | | 1 | p | p | p | p | | | | | | | | | |
| 22 | | 0 | -1 | | | | | | | | | p | p | p | p | | | NO PULSE | | | | | | | | | | | | |
| 23 | | | | | | | | | | | | | | | | | | | | | | | | | | | | | | |
| 24 | | 1 | 0 | | | | | | | | p | p | p | p | | | 9 | | | | | | | | p | p | p | p | | |
| 25 | | 1 | 1 | | | | | | | | p | p | p | p | | | 8 | | | | | | | p | p | p | p | | | |
| 26 | | 1 | 2 | | | | | | | | p | p | p | p | | | 7 | | | | | | p | p | p | p | | | | |
| 27 | | 1 | 3 | | | | | | | | p | p | p | p | | | 6 | | | | | p | p | p | p | | | | | |
| 28 | | 1 | 4 | | | | | | | | p | p | p | p | | | 5 | | | | p | p | p | p | | | | | | |
| 29 | | 1 | 5 | | | | | | | | p | p | p | p | | | 4 | | | p | p | p | p | | | | | | | |
| 30 | | 1 | 6 | | | | | | | | p | p | p | p | | | 3 | | p | p | p | p | | | | | | | | |
| 31 | | 4 | -1 | | | | | p | p | p | p | | | | | | | NO PULSE | | | | | | | | | | | | |
| 32 | | 1 | 7 | | | | | | | | p | p | p | p | | | 2 | p | p | p | p | | | | | | | | | |
| 33 | | 1 | -1 | | | | | | | | p | p | p | p | | | | NO PULSE | | | | | | | | | | | | |

*FIG. 8A*

| | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|
| 1 | | | | | | | | | | | | | | | | | | | | | | | | | | | | | | |
| 2 | | | | | | | | | | | | | | | | | | | | | | | | | | | | | | |
| 3 | PREV. CODE | LEAD CODE | LAG CODE | | | | | LEAD SYMBOL-FRAME 12-SLOTS | | | | | | | | | SLOTS BETWEEN PULSE | | | | LAG SYMBOL-FRAME 12-SLOTS | | | | | | | | | | |
| 4 | | | | | | | | | | | | | | | | | | | | | | | | | | | | | | |
| 5 | | | | | | | | | | | | | | | | | | | | | | | | | | | | | | |
| 6 | | | | | | | | | | | | | | | | | | | | | | | | | | | | | | |
| 7 | | | | | X | 7 | 6 | 5 | 4 | 3 | 2 | 1 | 0 | X | X | X | | X | 7 | 6 | 5 | 4 | 3 | 2 | 1 | 0 | X | X | X | |
| ⋮ | | ⋮ | | | ⋮ | | | ⋮ | | | ⋮ | | ⋮ | | | ⋮ | | ⋮ | | | ⋮ | | | ⋮ | | ⋮ | | | ⋮ | |
| 62 | | | | | | | | | | | | | | | | | | | | | | | | | | | | | | |
| 63 | | 5 | 0 | | | | p | p | p | p | | | | | | | 13 | | | | | | | | p | p | p | p | | |
| 64 | | 5 | 1 | | | | p | p | p | p | | | | | | | 12 | | | | | | | p | p | p | p | | | |
| 65 | | 5 | 2 | | | | p | p | p | p | | | | | | | 11 | | | | | | p | p | p | p | | | | |
| 66 | | 5 | 3 | | | | p | p | p | p | | | | | | | 10 | | | | | p | p | p | p | | | | | |
| 67 | | 5 | 4 | | | | p | p | p | p | | | | | | | 9 | | | | p | p | p | p | | | | | | |
| 68 | | 5 | 5 | | | | p | p | p | p | | | | | | | 8 | | | p | p | p | p | | | | | | | |
| 69 | | 5 | 6 | | | | p | p | p | p | | | | | | | 7 | | p | p | p | p | | | | | | | | |
| 70 | | 5 | 7 | | | | p | p | p | p | | | | | | | 6 | p | p | p | p | | | | | | | | | |
| 71 | | | | | | | | | | | | | | | | | | | | | | | | | | | | | | |
| 72 | | 6 | 0 | | | p | p | p | p | | | | | | | | 14 | | | | | | | | p | p | p | p | | |
| 73 | | 6 | 1 | | | p | p | p | p | | | | | | | | 13 | | | | | | | p | p | p | p | | | |
| 74 | | 6 | 2 | | | p | p | p | p | | | | | | | | 12 | | | | | | p | p | p | p | | | | |
| 75 | | 6 | 3 | | | p | p | p | p | | | | | | | | 11 | | | | | p | p | p | p | | | | | |
| 76 | | 6 | 4 | | | p | p | p | p | | | | | | | | 10 | | | | p | p | p | p | | | | | | |
| 77 | | 6 | 5 | | | p | p | p | p | | | | | | | | 9 | | | p | p | p | p | | | | | | | |
| 78 | | 6 | 6 | | | p | p | p | p | | | | | | | | 8 | | p | p | p | p | | | | | | | | |
| 79 | | 6 | 7 | | | p | p | p | p | | | | | | | | 7 | p | p | p | p | | | | | | | | | |
| 80 | | | | | | | | | | | | | | | | | | | | | | | | | | | | | | |
| 81 | | 7 | 0 | | p | p | p | p | | | | | | | | | 15 | | | | | | | | p | p | p | p | | |
| 82 | | 7 | 1 | | p | p | p | p | | | | | | | | | 14 | | | | | | | p | p | p | p | | | |
| 83 | | 7 | 2 | | p | p | p | p | | | | | | | | | 13 | | | | | | p | p | p | p | | | | |
| 84 | | 7 | 3 | | p | p | p | p | | | | | | | | | 12 | | | | | p | p | p | p | | | | | |
| 85 | | 7 | 4 | | p | p | p | p | | | | | | | | | 11 | | | | p | p | p | p | | | | | | |
| 86 | | 7 | 5 | | p | p | p | p | | | | | | | | | 10 | | | p | p | p | p | | | | | | | |
| 87 | | 7 | 6 | | p | p | p | p | | | | | | | | | 9 | | p | p | p | p | | | | | | | | |
| 88 | | 7 | 7 | | p | p | p | p | | | | | | | | | 8 | p | p | p | p | | | | | | | | | |
| 89 | | | | | | | | | | | | | | | | | | | | | | | | | | | | | | |
| 90 | | | | | X | 7 | 6 | 5 | 4 | 3 | 2 | 1 | 0 | X | X | X | | X | 7 | 6 | 5 | 4 | 3 | 2 | 1 | 0 | X | X | X | |

*FIG. 8C*

METHOD AND SYSTEM FOR FAST PULSE TELEMETRY

CROSS REFERENCE TO RELATED APPLICATIONS

This application claims the benefit of U.S. Provisional Application No. 63/573,581, filed Apr. 3, 2024, entitled "Method and System for Fast Pulse Telemetry", and is incorporated herein by reference.

STATEMENT REGARDING FEDERALLY SPONSORED RESEARCH OR DEVELOPMENT

Not applicable

REFERENCE TO APPENDIX

Not applicable

BACKGROUND OF THE INVENTION

Field of the Invention

The disclosure generally relates to remote communications in a wellbore with surface operations. More specifically, the disclosure relates to communications between downhole tools during subterranean operations, such as drilling hydrocarbon wells, and surface equipment, including measurements while drilling communications and/or logging while drilling communications.

Description of the Related Art

Telemetry has been defined as the science and technology of automatic measurement and transmission of data by wire, radio, or other means from remote sources to receiving stations for recording and analysis. Telemetry is practiced in many environments from below the earth in oilfield transmissions from downhole instruments to environments above the earth from space vehicles. The telemetry is typically transmitted from a sending unit to a receiving station for data processing and output that is needed for operational guidance or input. A key issue is the integrity of the transmitted data particularly in environments that are constrained in the data rates from the methodology of transmission available for the application.

FIG. 1 is a schematic example of a typical system using telemetry to communicate data from a downhole tool in a well bore to a receiving station at the surface. An oil rig 102 generally is used to drill a hydrocarbon well 104 to establish a wellbore 106.

A drill string 8 of pipe and tooling is progressively inserted into the wellbore as drill bits progressively deepen the wellbore. A mud pump 10 pumps mud through an inlet conduit 12 to the drill string 8 to travel downward through the drill string and through a downhole telemetry tool 14 with a modulator and a Bottom Hole Assembly (BHA) 16 with a drill bit 18 to help flush cuttings from the drill bit. The mud pressure causes the mud and cuttings to return up an annulus between the larger wellbore and the small drill string to the surface and into a return conduit 20. The mud flows over a screen to separate larger particles and returns to the mud pit 22. In oil field operations for Measurements While Drilling (MWD) services, various measurements data acquired downhole is sent from the downhole telemetry tool 14 that aggregates data and sends using various telemetry methodology like mud-pulse, electromagnetic, acoustic, wired drill pipe and others. A related process is Logging While Drilling (LWD). The MWD and/or LWD can be generally referred to herein as MLWD and the downhole telemetry tool 14 is typically an MLWD tool in an MLWD system that can transmit measurement data via telemetry to an uphole receiving station 24 generally with a processor for extracting the telemetry data. Current MLWD methodology using mud telemetry depends on the mud flowing in the downhole pipes and actively circulating in a drilling column circuit between downhole and surface locations. The telemetry is typically sent in sequences. The order of the data sent uphole in any of the sequences is predetermined based on the sequence identifier word preceding the sequence data.

FIG. 2A is a schematic cross-sectional diagram of a typical operation of a positive pulse mud operated pulser of the downhole telemetry tool. FIG. 2B is a schematic cross-sectional detail of a typical orifice flow area with a needle valve of a poppet in proximity. FIG. 2C is a schematic graph of illustrative pulses produced from the mud operated pulser. The downhole mud pulser transmits values as a series of mechanical pulses translated into series of pressure pulses as coded signals to a receiver such as the surface receiving station 24 in FIG. 1 for decoding the communication.

There are two basic methods (negative or positive pressure generation) to send pressure signals to surface. The most widely used MLWD system considers the second method that sends positive pressure signals to surface. A positive pulse is created by increasing the local differential pressure at a flow area 28 in the downhole telemetry tool 14 where the flow through that flow rate is pumped across the bit 18. One method to create a positive pulse is to temporarily restrict a portion of a flow area 28, which increases the local differential pressure and propagates a pulse to the surface, yet still allows flow across the drill bit. The flow area can be restricted with an axial motion or rotational motion.

An example of restricting the flow with axial motion is a Mud Operated Pulser (MOP). A MOP 26 is one of most widely used MLWD systems in the industry. The function of a MOP is to extend and retract a poppet 30 (as a main valve) in an orifice 32 repeatedly to generate pressure pulses with a desired pulse width and pulse spacing.

As shown in FIG. 2A, when a needle valve 34 of the poppet 30 is in open position, retracted downward in its normal state, the flow of the mud is not restricted and hence creates a steady low pressure. When the needle valve 34 is actuated as in FIG. 2B, the needle valve moves upward, choking the flow of the mud partially through the orifice 32 and creating a higher pressure above the orifice. In a normal MLWD operation, these pressure changes travel upwards within the drill pipe 8 to the surface. As shown in FIG. 2C, the MLWD tool creates a series of pulses 36 (in this illustration, positive pulses) using this mechanism. By modulating the pulse width W and/or pulse spacing S relative to other pulses, a message can be transmitted to the surface as a telemetry digital communication and decoded.

This telemetry can include, for example, survey data (such as azimuth, inclination, and dip), and drilling data (such as tool face and gamma count). The data is encoded as a series of pulses positions, which allow the pulses to be reconstructed over time.

Data transmission is broken into symbol-frames. Each symbol-frame represents one, or part of, a field of telemetry. In general, a symbol-frame may have 12 or 8 slots of time. Within that time, a single pulse will occur. At the end of each symbol-frame, typically three slots are designated as guard slots. There is also one guard slot at the beginning of each symbol-frame. A pulse could start on the front guard slot, but will never occur within any of the three ending guard slots to allow time for the discriminating from the succeeding signal.

FIG. 3 is schematic diagram of a typical 12-slot frame that represents a 3-bit symbol. The pulses are read left to right. Of the twelve slots in this type of frame 50, eight slots 52 are representing octal value from 7 through 0, one slot is a beginning guard slot 54, and the three remaining slots are the three ending guard slots 56. When sequencing with preceding and succeeding symbol-frames, the beginning guard slot 54 and three ending guard slots 56 creates together four guard slots to separate the intended signals. Pulses 36 occupy two slots 52 within a symbol-frame 50. The second slot of the pulse determines the resulting octal value. The slots 7 and 6 in this example represent a possible pulse 36 with a resulting code 6 of a pulse value 42.

The downhole pulser 26 has a bitstream of coded information to transmit to surface. In a 12-slot symbol-frame 50, the first three bits of the bitstream are converted to a value between 0 and 7 and a pulse 36 is created at the right position in the symbol-frame. For the transmission of the next symbol-frame 50, again the next three bits are examined and converted to a corresponding value between 0 and 7 and a pulse representing the value is generated in that symbol-frame. This process continues until the pumps are ON and circulating the mud. At the surface, the reverse process is executed. The receiving station determines a boundary of a symbol-frame generally using the beginning guard slot 54 and ending guard slots 56, and determines the location of the pulse 36 within the symbol-frame 50 that defines the value of 0 to 7 based on that position. The process continues until sequence of pulses making up the bitstream of coded information is received from the downhole tool and the information can be decoded.

FIG. 4 is schematic diagram of a typical 8-slot symbol-frame that represents a 2-bit symbol. Of the eight slots in this type of symbol-frame 50', four slots 52' are available from 3 through 0, one slot is a beginning guard slot 54, and the three remaining slots are the three ending guard slots 56. Pulses 36 occupy two slots, and likewise, the second slot of the pulse determines the resulting value. The slots X and 3 in this example represent a possible pulse 36 with a resulting value of 3.

FIG. 5 is schematic diagram of portions of two consecutive typical 12-slot symbol-frames with 2-slot pulse widths. The pulses 36 are illustrated as occurring on the slots 1 and 0 for the first pulse 36A for a code 0, and then slots 6 and 5 for the second pulse 36B for a code 5. Between the pulses, there are five slots of three Xs for the ending guard slots 56 of pulse 36A and one beginning guard slot 54 and slot 7 for pulse 36B. If the pulse width is 1.0 seconds, each slot would represent 0.5 seconds, and the time between pulses, which is the time between trailing edge of the first pulse 36A to the leading edge of the second pulse 36B, would be 2.5 seconds. The number of slots between pulses is the distance from the trailing end of the first pulse to the leading edge of the second pulse.

In general, a telemetry speed is measured in the number of bits which are transmitted in a fixed time interval such as seconds. In the case described above, with a one-second pulse width of two slots of 0.5 seconds each, the 12-slot symbol-frame is six seconds long. As described above in this 12-slot symbol-frame, a value of 3 bits can be transmitted. Hence, the bit rate of 3 bits every 6 seconds yields a rate of 0.5 bits/second. This 0.5 bits/second rate is very typical in the industry today for relatively shallow wells.

One of the challenges today is that downhole tools now can measure many parameters of the formation and other information about the location and drilling efficiency. Hence, there is a tremendous need to increase the physical telemetry rates to transmit more information to the surface that will allow a driller to place the well safely in a more accurate path.

The pulse modulation schema described above requires the pulser width to be two slot widths. Under this requirement, the maximum bandwidth is decided by the pulse width. As the measured depth of the well increases, attenuation of the pressure pulse generated by downhole MLWD tool also increases, resulting a smaller signal received on the surface, in turn decreasing the signal-to-noise ratio and decreasing the quality of the telemetry. To be able to better detect the attenuated signals, the bit rate is slowed even more to allow longer times between pulses for differentiation.

When the need is for more information and not less, the slower bit rate presents a significant challenge to transmit enough information to the surface to drill the well accurately and efficiently. Therefore, there remains a need for an improved telemetry rate without sacrificing the quality of the signal.

BRIEF SUMMARY OF THE INVENTION

The disclosure provides a method and system for multiple symbol-frames to encode and decode each bitstream value in contrast to current schemes of encoding and decoding the bitstream based on evaluating single symbol-frames for each bitstream value. By evaluating multiple symbol-frames and their relationship to each other to encode and decode each bitstream value, the relationship between the pulse width and symbol-frame width can be varied. The description of the exemplary embodiment maintains the same symbol-frame width with a much wider pulse and encoding and decoding multiple symbols to achieve higher data rate telemetry while maintaining the integrity of a signal. The method and associated software to code and decode multiple symbol-frames and their relationship to each other has demonstrated multiples of increased speed that significantly increases the capability of telemetry communication.

The disclosure provides a method of telemetry pulse modulation for communicating information, comprising: determining if a number of symbol-frame slots between a first pulse, having a position in a first symbol-frame that establishes a first original code, and a second pulse, having a position in a second symbol-frame that is consecutive to the first symbol-frame and that establishes a second original code, is less than a prescribed threshold of symbol-frame slots, and if the number is less than the prescribed threshold, then altering at least one of the original codes to establish a predetermined altered code; encoding any remaining original codes and predetermined altered codes; transmitting the pulses according to codes to a decoder; and decoding the transmitted codes from the predetermined altered codes into the original codes and together with any unaltered original codes and communicating the original codes containing the information.

The disclosure also provides a system for telemetry pulse modulation containing information, comprising: an encoder having an encoding processor and a computer readable memory including processor executable instructions that, when executed by the encoding processor, cause the system to perform encoding operations, and a decoder having a decoding processor and a computer readable memory including processor executable instructions that, when executed by the decoding processor, cause the system to perform encoding and decoding operations comprising: determining if a number of symbol-frame slots between a first pulse having a position in a first symbol-frame, establishing a first original code, and a second pulse having a position in a second symbol-frame that is consecutive to the first symbol-frame, establishing a second original code, is less than a prescribed threshold of symbol-frame slots, and if the number is less than the prescribed threshold, then: altering at least one of the original codes to establish a predetermined altered code; encoding any remaining original codes and predetermined altered codes; transmitting the pulses according to codes to a decoder; and decoding the transmitted codes from the predetermined altered codes into the original codes and together with any unaltered original codes and communicating the original codes containing the information.

BRIEF DESCRIPTION OF THE SEVERAL VIEWS OF THE DRAWINGS

FIGS. 8A-8C represent a single schematic table of an alternate code database illustrating of an exemplary set of codes according to the invention for two consecutive 12-slot symbol-frames.

DETAILED DESCRIPTION

Figure 1:
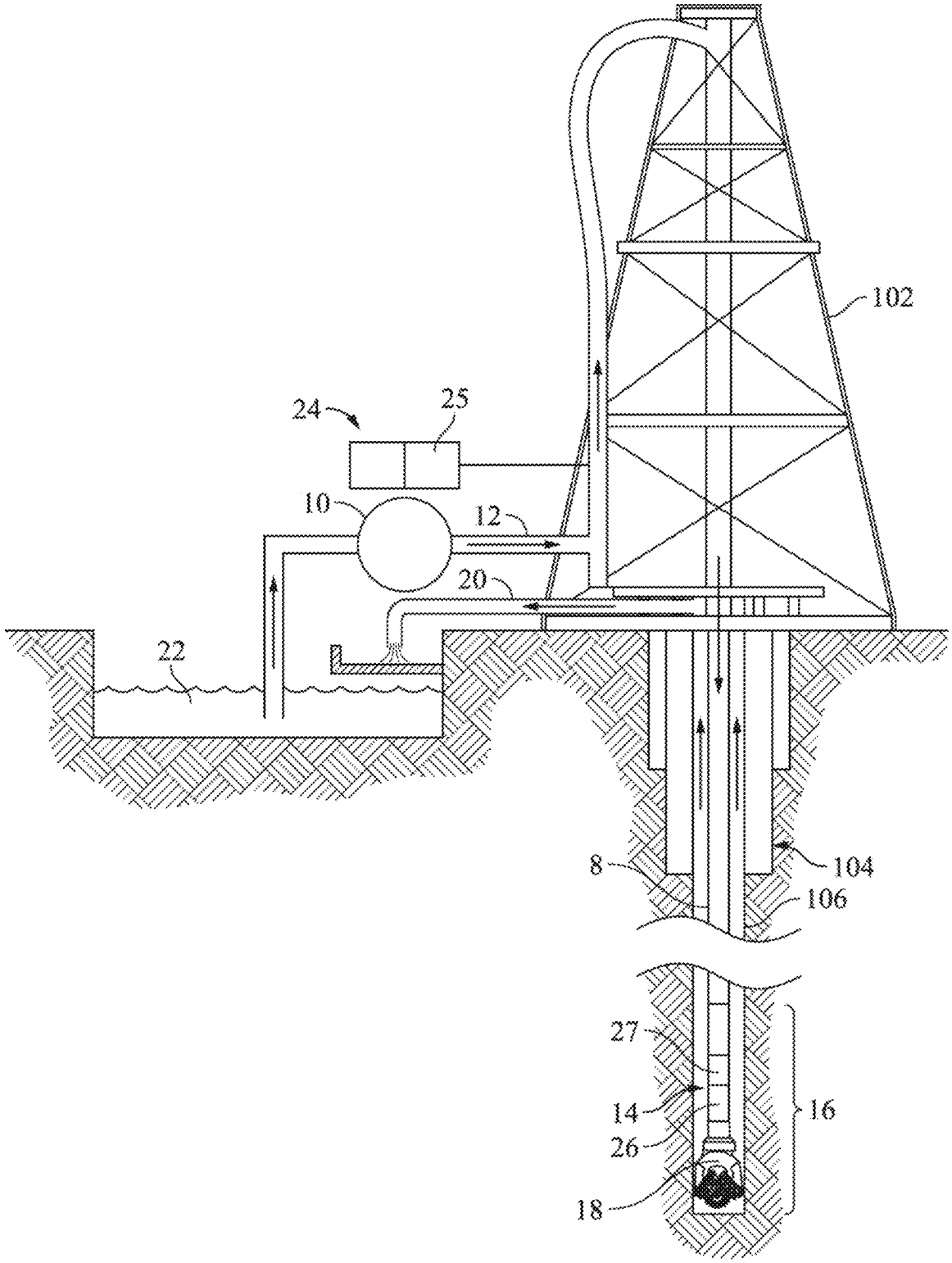
FIG. 1 (Prior Art)
FIG. 1 is a schematic example of a typical system using telemetry to communicate data from a downhole tool in a well bore to a receiving station at the surface.

The Figures described above, and the written description of specific aspects and functions below are not presented to limit the scope of what Applicant has invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present disclosure will require numerous implementation-specific decisions to achieve the developer's ultimate goal for the commercial embodiment. Such implementation-specific decisions may include, and likely are not limited to, compliance with system-related, business-related, government-related, and other constraints, which may vary by specific implementation or location, or with time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. The use of a singular term, such as, but not limited to, "a," is not intended as limiting of the number of items. Further, the various methods and embodiments of the system can be included in combination with each other to produce variations of the disclosed methods and embodiments. Discussion of singular elements can include plural elements and vice-versa. References to at least one item may include one or more items. Also, various aspects of any embodiments could be used in conjunction with each other to accomplish the understood goals of the disclosure. Unless the context requires otherwise, the term "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The term "exemplary" is the adjectival form of "example" and is used to illustrate a concept of which there may be many examples. The order of steps can occur in a variety of sequences unless otherwise specifically limited. The various steps described herein can be combined with other steps, interlineated with the stated steps, and/or split into multiple steps. Some elements are nominated by a device name for simplicity and would be understood to include a system or a section, such as a controller would encompass a processor and a system of related components that are known to those with ordinary skill in the art and may not be specifically described. Various examples are provided in the description and figures that perform various functions and are non-limiting in shape, size, description, but serve as illustrative structures that can be varied as would be known to one with ordinary skill in the art given the teachings contained herein. The subsurface terms "downhole" and "uphole" are relative to proximity to a ground surface, where uphole is closer, regarding of the actual gravitational orientation of up or down.

The disclosure provides a method and system for multiple symbol-frames to encode and decode each bitstream value in contrast to current schemes of encoding and decoding the bitstream based on evaluating single symbol-frames for each bitstream value. By evaluating multiple symbol-frames and their relationship to each other to encode and decode each bitstream value, the relationship between the pulse width and symbol-frame width can be varied. The description of the exemplary embodiment maintains the same symbol-frame width with a much wider pulse and encoding and decoding multiple symbols to achieve high quality, higher data rate telemetry while maintaining the integrity of a signal. The method and associated software to code and decode multiple symbol-frames and their relationship to each other has demonstrated multiples of increased speed that significantly increases the capability of telemetry communication.

Figure 6:
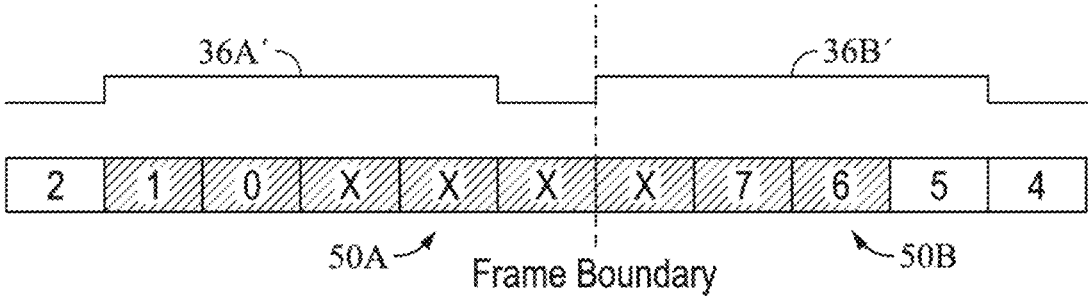
FIG. 6 is a schematic diagram of an illustrative 12-slot symbol-frame with enlarged pulse widths of adjacent symbol-frames according to the invention.

FIG. 6 is a schematic diagram of an illustrative 12-slot symbol-frame with enlarged pulse widths of adjacent symbol-frames according to the invention. To maintain the desired signal-to-noise ratio (SNR) at surface, one might propose using a longer pulse width 36A', 36B' as the wellbore becomes deeper. However, that proposed solution would result in decreasing the telemetry bandwidth. For example, when the pulse width is increased from 1 second to 2 seconds, the overall bit rate drops from 0.5 bits/second to 0.25 bits/second.

Figure 3:
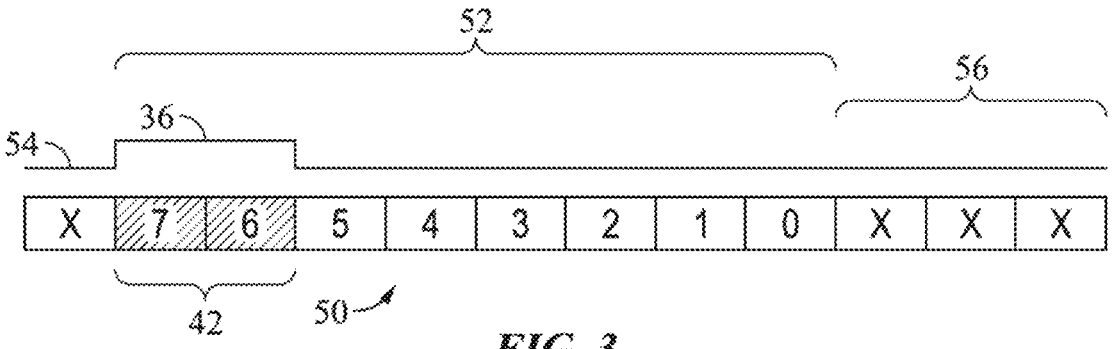
FIG. 3 (Prior Art)
FIG. 3 is schematic diagram of a typical 12-slot frame that represents a 3-bit symbol.
Figure 4:
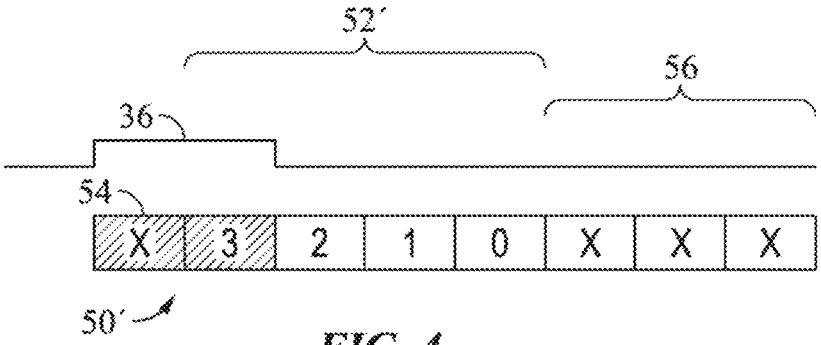
FIG. 4 (Prior Art)
FIG. 4 is schematic diagram of a typical 8-slot symbol-frame that represents a 2-bit symbol.
Figure 5:
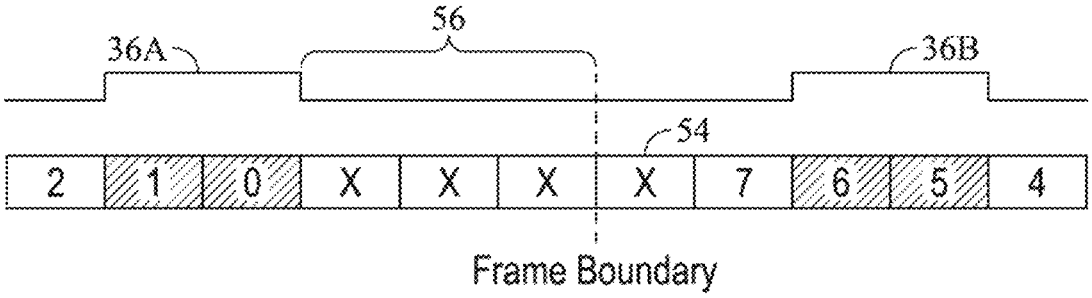
FIG. 5 (Prior Art)
FIG. 5 is schematic diagram of portions of two consecutive typical 12-slot symbol-frames with 2-slot pulse widths.

One might propose to simply decouple the pulse width with the slot size. However, such a proposal would not work for some slots, rendering the communications ineffective in those cases. Assuming the pulse width is 4 times (4*x*) the slot size, that is, each pulse width occupies 4 slots instead of the typical 2 slots illustrated in FIGS. 3-5 above. The symbol sequence code set in the two consecutive symbol-frames that are next to each other is a code 0 pulse value in symbol-frame 50A followed by a code 7 pulse value in symbol-frame 50B, that is [0, 7], using the customary nomenclature of a typical 2-slot pulse width, where the second slot of the pulse determines the resulting code. However, in this example of FIG. 6, the 2-slot pulse width is expanded to 4-slot widths particularly to solve the issues with greater wellbore depths. The increased widths in the two consecutive pulses result in only one slot between the pulses and become difficult to distinguish during the demodulation process at the surface at the typical speed, resulting in errors in communications. It is also very difficult for the mechanical pulser to operate fast enough to generate two distinguishing pulses. Practically, those two consecutive pulses in close proximity would be interpreted as a single giant pulse. When a pressure wave travels several thousand feet from the downhole tool to the surface pressure transducer, the pulse magnitude is attenuated in the fluid. Also, the pulse edges are no longer sharp as these edges smear over distance. Hence, if two pulses are close as shown in FIG. 6, they almost look as one long pulse. In addition, there are other fluidic noise sources like reflections and drilling noise superimposed on these pressure pulses and make distinguishing two close pulses from each other virtually impossible at the surface.

While the above proposals solve some of the prior art issues, the proposals do not appear to offer a sufficiently satisfactory solution. More fundamentally, existing encoding and decoding is depending on only one symbol-frame based on a single symbol. In contrast, the solution described herein for the invention is not limited to single symbol-frame encoding and decoding. The invention describes a multiple symbol-frame coding and decoding to achieve a robust higher data rate telemetry compared to the existing practice under similar environmental conditions. For illustration, an exemplary embodiment describes encoding and decoding two symbol-frames as a pair and at times three symbol-frames for special cases. However, such an embodiment is not limiting, as it is envisioned that three or four or even larger groups of symbol-frames can be encoded and decoded jointly based on the application and need.

The invention employs a "skip" concept to analyzing groups of adjacent symbol-frame codes together, as explained and illustrated herein, and can advantageously still use the standard 2-slot pulse width, if desired. "Skip" herein means no actual pulse (represented as a "skip code" designated by an arbitrary symbol) in the physical telemetry is generated in the skipped symbol-frame by the encoder to be sent to the decoder. Generally, the encoder receives data that needs original codes used to generate specific actual pulses coded to communicate the data to a decoder. However, multiple symbol-frames are analyzed in groups to determine whether prospective positions of the pulses in adjacent symbol-frames could result in pulses being separated by less than a prescribed threshold of slots, such as 3, 4, 5 or 6 slots. If that situation occurs, then using the inventive method, the encoder "skips" generating a pulse code, and therefore a pulse, for at least one symbol-frame of the adjacent symbol-frames, and inserts a predetermined altered code for any other symbol-frames that are not skipped. The encoder can send any remaining original codes and any predetermined altered codes in pulses as a multiple symbol-frame code set to the decoder. The decoder recognizes the predetermined altered codes, such as in Table 1 below, and reconverts the predetermined altered codes based on the relationship between the original code and predetermined altered codes to the original code set and extracts the data intended to be communicated by the encoder.

Generally but not exclusively, using two adjacent symbol-frames, a second original code for the second symbol-frame can be skipped and a predetermined altered code can be assigned to the second original code. The first original code of a first symbol-frame can be reported without needing alteration, because there is no longer a spacing issue with a second original code. The first original code can then be transmitted to the decoder as a pulse, and the second predetermined altered code can then be used for further evaluation for the subsequent symbol code set and then transmitted to the decoder. The second predetermined altered code can be decoded to recreate the second original using the first original code that is in turn used to communicate the intended bitstream sequence. For illustration, in another embodiment, the reverse situation could occur by assigning the first original code to a first predetermined altered code that is transmitted to the decoder as is the second original code for decoding the first predetermined original code using the second original code.

Figure 7:
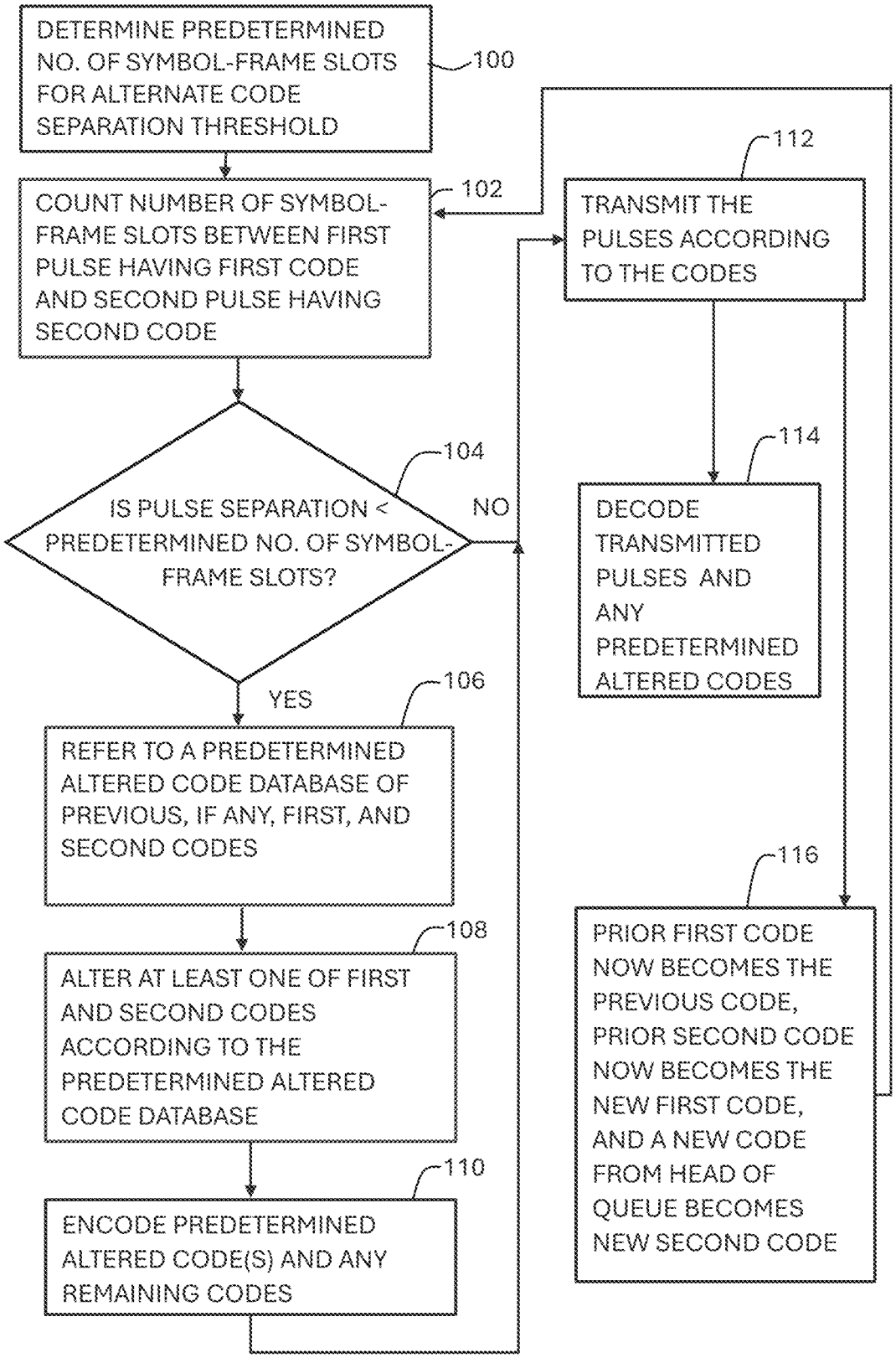
FIG. 7 is a flow chart illustrating an example of a process according to the invention.

FIG. 7 is a flow chart illustrating an example of a process according to the invention. In step 100, a threshold is predetermined on the number of separation symbol-frame slots for deciding whether altered codes will be applied. Generally, the determination is based on a balance of seeking a quality signal despite the signal attenuation compared to a desired speed of the signal transmission. In step 102, the process counts the number of symbol-frame slots between a first pulse having a first code and a second pulse having a second code. Positions of the first and second pulses in their respective symbol-frames can establish the first and second codes, respectively. In step 104, the process inquires if the pulse separation is less than the predetermined threshold. If not, then the pulses with their respective codes are encoded in the conventional manner and can be transmitted in step 112 and then decoded in step 114 into the original codes for communicating the intended information for the transmission. Quantitatively, the majority of the pulses with their codes can be transmitted without requiring an alteration. In step 106, in which the pulse separation is less than the predetermined threshold (that might affect the signal quality), the process can refer to a predetermined altered code set, such as can be stored as a database for the processor to access. In step 108, the process alters at least one of first and second codes according to the predetermined altered code database as described herein to facilitate a higher probability of an accurate transmission. In step 110, the process encodes the predetermined altered code(s) and any remaining codes, and transmits the encoded pulses as referenced above in step 112. In step 114, the process decodes the transmitted pulses for the predetermined altered codes and then converts the predetermined altered codes into the original codes, as well as convers the transmitted pulses of any remaining original codes into their original codes that together can form the intended information for the transmission. In step 116, the process can index to the next pulse by shifting the prior first code to become the previous code, the prior second code to become the next first code, and a new code from the head of a queue to become the new second code to repeat the process for the codes having the information that is intended to be transmitted.

However, some special situations can occur needing special treatment and are variations of the general statement in the preceding paragraph, explained in more details in Table 1. Such instances can utilize the previous symbol code (a symbol code can be either an original code or a predetermined altered code, as the case may be) of a previous symbol-frame preceding the first symbol frame, that is, three symbol-frames having three symbol codes, to communicate the altered codes and any original codes and decode at the receiving station, as explained herein. Thus, a general step description for communicating information, generally through a telemetry pulse, would be as follows:

1. Establish a sequentially updating, original symbol-frame code queue of symbol codes (generally first-in-first-out basis), having an initial previous symbol code, first original code, and second original code;
2. Evaluate the previous symbol code, first original code, second original code at the head of the queue;
3. Determine if the first original code and/or second original code need predetermined altered code(s) for the first original code and/or second original code set, based on an predetermined code association such as in a database shown in FIGS. 8A-8C that is a 3-bit representation of data of which Table 1 is a partial representation, and FIG. 9 that is a 2-bit representation of data of which Table 2 is a partial representation;
4. If an altered code is needed, then generate an altered code for at least one of the first original code and second original code, as needed, based on the predetermined alternate code association and replace any relevant original code with any predetermined altered code in the symbol-frame code queue;
5. Encode and transmit the previous symbol code (whether altered or original code) in the symbol-frame code queue via a telemetry pulse to a receiver station;
6. Shift the symbol-frame code queue by removing the previous symbol code;
7. Establish a new set of a previous symbol code (previously the first original code of the prior set), first original code (previously the second original code of the prior set), and second original code (a new original code);
8. Repeat the process from step (2);
9. Receive the transmitted altered codes and any remaining transmitted original codes by a decoder and decode the transmitted altered code(s) according to the predetermined code association into its respective original code(s) that were previously altered and communicate with the other original codes the information.

Figure 8B:
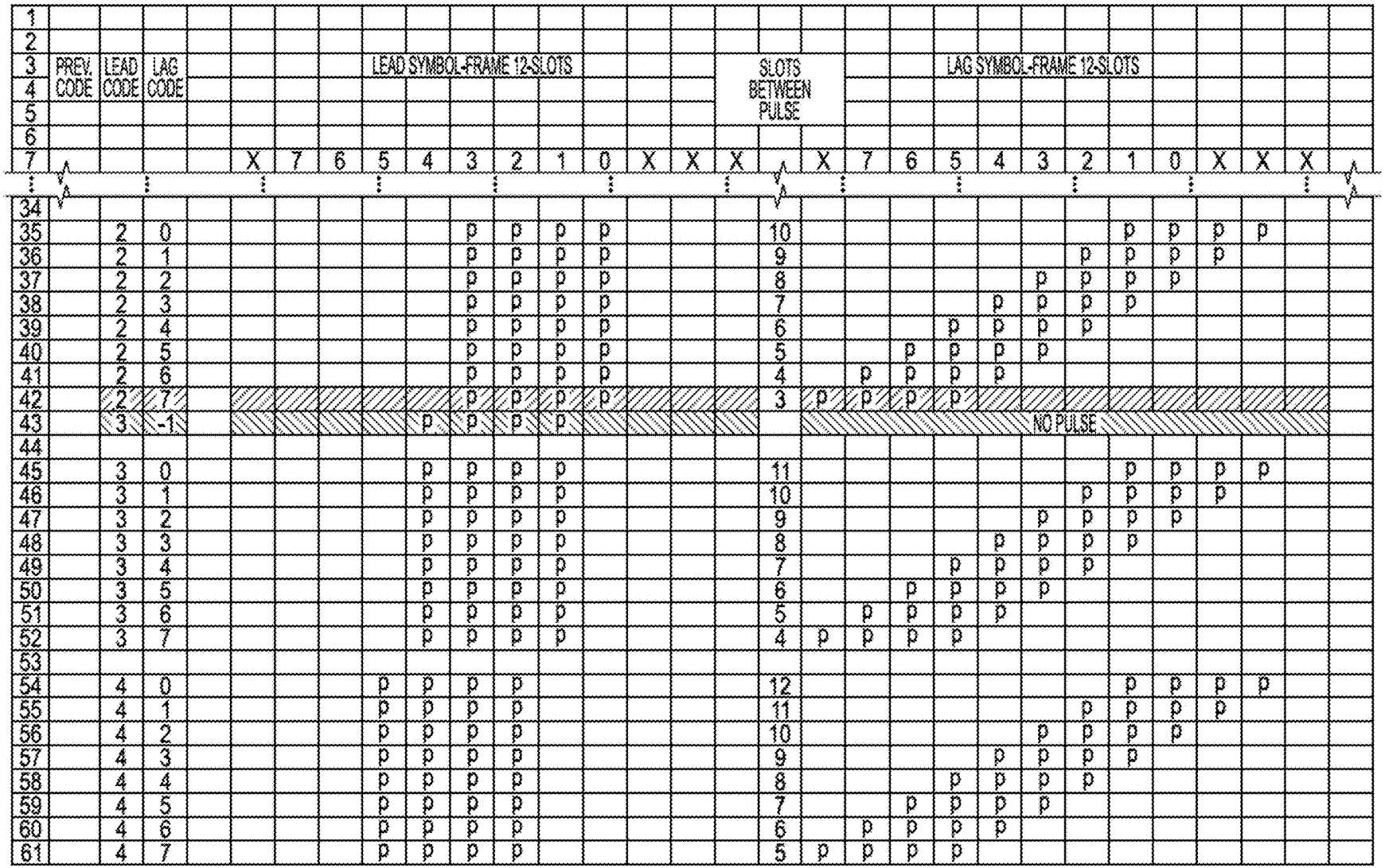

Table 1, a part of the alternate code database of FIGS. 8A-8C, illustrates a nonlimiting example of an embodiment of the skip methodology invention, showing exemplary values for two consecutive 12-slot symbol-frames with 4-slot wide pulses. As an example, a symbolic value can be assigned as a symbol of a skip code, such as a "−1". Special cases of codes are shown in the last two lines of Table 1 and explained in more detail herein.

TABLE 1

Two Consecutive 12-slots Frame with 4-slot Pulse

| Original Pulse Modulation | | |
|---|---|---|
| Code Sets | # of Slots Between Pulses | Altered Code Sets under Skip Methodology |
| [c, 0, 7] | 1 | [c, 0, −1] |
| [c, 1, 7] | 2 | [c, 1, −1] |
| [c, 0, 6] | 2 | [c, 2, −1] |
| [c, 2, 7] | 3 | [c, 3, −1] |
| [c, 1, 6] | 3 | [c, 4, −1] |
| [0, 0, 5] | 3 | [0, −1, −1] |
| [1 . . . 7, 0, 5) | 3 | [1 . . . 7, 5, −1] |

FIGS. 8A-8C represent a single schematic table of an alternate code database illustrating a database of an exemplary full set of codes according to the invention for two consecutive 12-slot symbol-frames. FIGS. 8A-8C are useful in conjunction with Table 1 to better understand the method of the invention. From left to right, the columns show a previous symbol-frame code, a lead (first) symbol-frame code, and a lag (second) symbol-frame code, then the 12 slots described in FIG. 3 for the lead symbol-frame showing various pulse positions, the number of slots between the consecutive pulses, and lastly the 12 slots for the lag symbol-frame. Lines, such as line 15, indicate the pulses are too close for a robust telemetry.

Lines with a cross-hatching of a right upward slant direction (that is, northeast in a compass orientation) indicate first and second code sets having issues with the spacing being too close for an exemplary wider pulse width of four slots for more clarity and/or speed, namely lines 15, 17, 19, 21, 30, 32, and 42 in this embodiment. Lines with a cross-hatching of a left upward slant direction (that is, northwest in a compass orientation) indicate altered code sets, namely lines 16, 18, 20, 22, 31, 33, and 43, respectively that are processed according to an exemplary embodiment of the invention to resolve the issue in lines 15, 17, 19, 21, 30, 32, and 42. Further, lines 16 and 18 of FIG. 8A and shown in last two lines of Table 1 are populated with special altered code values for specific cases of codes in lines 15 and 17, as explained in more detail below.

As an example of the methodology shown in the first row of Table 1 and line 21 of FIG. 8A, if the downhole encoder sees a code of 0 followed by a code of 7 for two consecutive symbol-frames, the pulses in a normal 2-slot encoding scheme would have been four slots apart. For a more robust telemetry with wider pulse widths for more clarity and/or more speed, here 4-slots pulse widths, the pulses will only be one slot apart, as shown in FIG. 6. This separation is too close for robust telemetry all the way up to the surface decoder. The method skips sending the second pulse with a code of 7. Instead, the downhole encoder inserts a skip code of −1 in place of the code of 7 and therefore processes the original code set [0, 7] shown in line 21 of FIG. 8A, as an altered code set [0, −1], as shown in the line 22 and the first line in Table 1. In this embodiment, the arbitrary value of "−1" has been chosen as the skip code to indicate No Pulse in that symbol-frame. Then, on the surface when the decoder sees a pair of symbol-frames encoded as a code set [0, −1] indicating no pulse attribution in the second symbol-frame, the decoder decodes the pair as the original code set [0, 7] of a code of 0 followed by a code of 7, as shown in Table 1, which is represents the actual pulse octal values encoded by the downhole encoder.

Therefore, if the encoder which receives the original codes and can make such determinations of pulse proximity as described herein, does not send a pulse value in the second symbol-frame of code 7, then the decoder does not have to decode a pulse that would have been unreliably indistinct by the time the transmission is received typically at the surface by the decoder. The surface decoder simply recognizes the combination of the code set [0, −1] where the pulse for the first code value is recognizable by the surface decoder and then converts the code set [0, −1] to the original code set [0, 7] that the downhole encoder received before it encoded the original code set as the altered code set [0, −1] before transmitting uphole.

The downhole tool and the surface decoder both run on an independent clock system. Even though they are chosen to be very low drift with highly accurate clock systems, they do drift from each other. Hence, the surface clock system derives the correction to this drift on regular intervals from the continuous clock pulses received from the downhole tool pulses. This correction is applied to the surface clock system continually to keep both the surface and the downhole clock systems in synchronization to accurately decode the pulses. However, if a long series of −1 codes is coded downhole there are no pulses for a long time, and a long gap of time without any pulses from a downhole tool may cause the clocks to drift apart to such an extent that when operations and pulses resume, the pulses will be incorrectly decoded in incorrect time slots. This drift will be disastrous for the quality of the telemetry, because all the data decoded by the surface decoder will be incorrect. To avoid this condition of no pulses of an original code of [0 . . . 7, 0, 5] for an extended period of time, the last two lines of the Table 1 above are provided as special coding situations and are shown in lines 15 to 18 of FIG. 8A. The special coding produces a pulse in at least three consecutive symbol-frames.

As shown in the second to the last line of Table 1, the original code [0, 5] is shown as [0, 0, 5]. This code is replaced by the altered code [0, −1, −1], which means that there will be no pulse in the lead (also referred to as first) symbol-frame and the lag (also referred to as second) symbol-frame. In more detail, the very first code of the three codes is the previous symbol-frame code. If the encoder in the downhole tool receives several consecutive codes of [0, 5], they are simply replaced by the altered codes [−1, −1], signifying there will be no pulse in those consecutive pairs of symbol-frames. If the previous symbol-frame code was code 0, the code 0 is combined with the altered codes [−1, −1] to create the altered symbol code [0, −1, −1]. This code set can be encoded and sent uphole to the decoder. The decoder recognizes the sequence and decodes as a [0, 5] code.

As shown in the last line of Table 1, if the previous symbol code was between 1 to 7, the original code [0, 5] is replaced by an altered code [5, −1] and so the total altered code is [1 . . . 7, 5, −1], such as [2, 5, −1]. This conversion avoids sending a long series of symbol-frames without any pulses.

Not all code sets need special altered coding according to the skip methodology. If the distance between the pulses is determined to be sufficiently wide to be reliably decoded by the surface decoder, then the standard nomenclature for coding can be used. For example, in FIG. 8A, the code set [1, 2] has a 7-slot separation between the two pulses and is considered sufficient for the robust telemetry. Separation between the two pulses for a robust telemetry depends on different conditions of the acoustic system in which the telemetry operates and can be decided based on the application. For example, this embodiment has used a minimum separation of four slots to demonstrate the concept of the invention.

Table 2 illustrates a nonlimiting example of an embodiment of the skip methodology invention, showing exemplary values for two consecutive 8-slot symbol-frames. In the illustrative embodiment, Table 2 has the corresponding concepts as detailed for Table 1, but adapted for the 8-slot symbol-frames.

TABLE 2

| Two Consecutive 8-slots Frames with 4-slot Pulse | | |
|---|---|---|
| Original Pulse Modulation | | |
| Code Sets | # of Slots Between Pulses | Altered Code Sets under Skip Methodology |
| [c, 0, 3] | 1 | [0, −1] |
| [c, 1, 3] | 2 | [1, −1] |
| [c, 0, 2] | 2 | [2, −1] |

Figure 9:
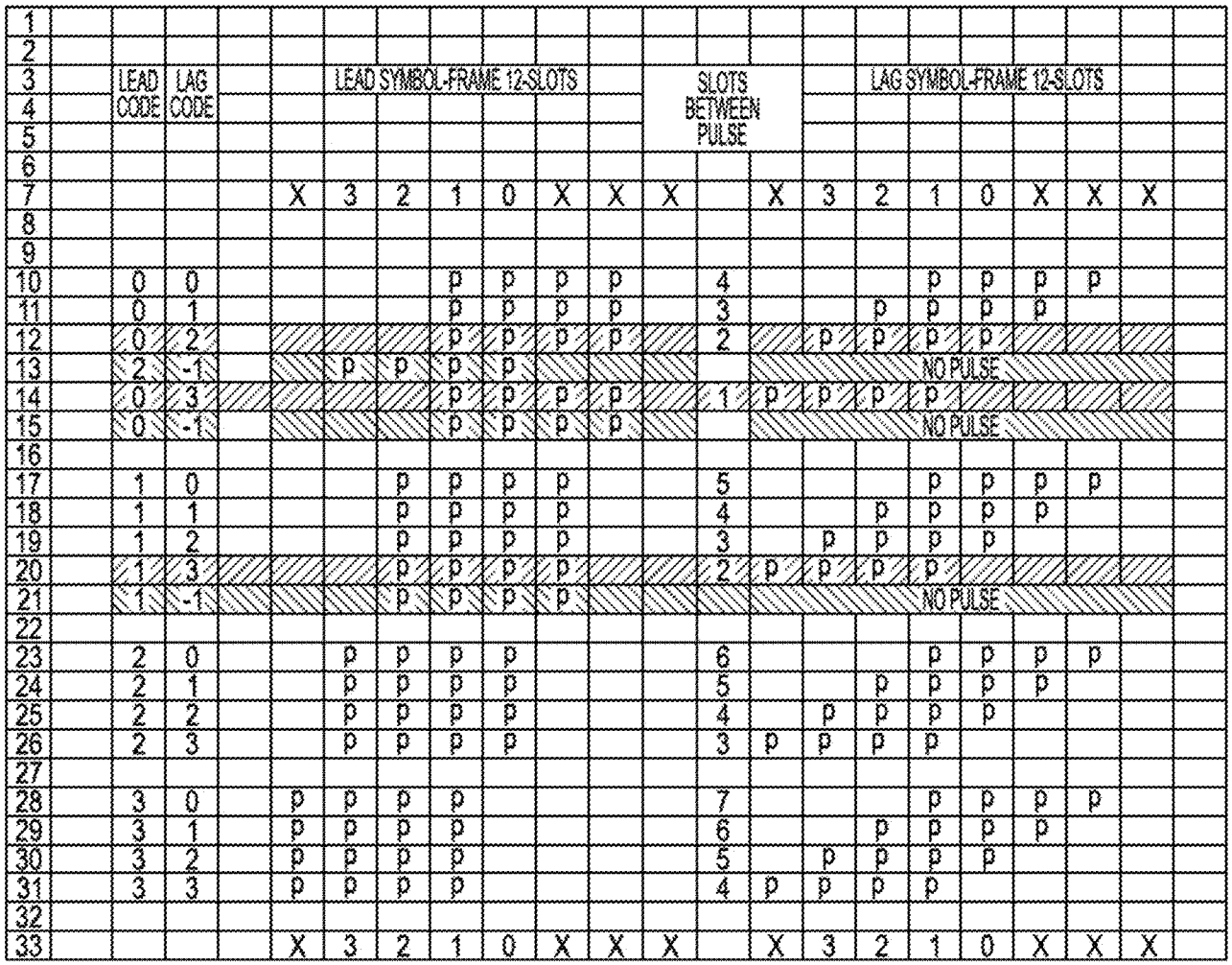
FIG. 9 is schematic table of an alternate code database illustrating an exemplary set of codes according to the invention for two consecutive 8-slot symbol-frames.

FIG. 9 is schematic table of an alternate code database illustrating an exemplary set of codes according to the invention for two consecutive 8-slot symbol-frames. In the illustrative embodiment, FIG. 9 has the corresponding concepts as detailed for FIGS. 8A-8C, but adapted for the 8-slot symbol-frames. The column and row descriptions are similar and shows the original codes and their replacement altered codes when the pulses in consecutive symbol-frames are too close for robust telemetry.

Figure 2B:
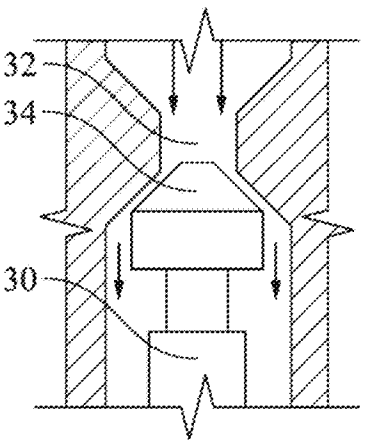
FIG. 2B (Prior Art)
FIG. 2B is a schematic cross-sectional detail of a typical orifice flow area with a needle valve of a poppet in proximity.
Figure 2C:
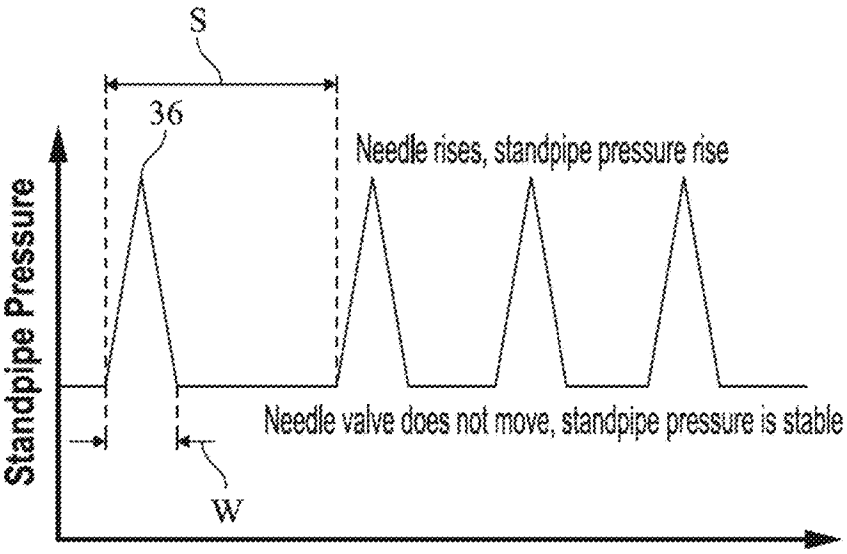
FIG. 2C (Prior Art)
FIG. 2C is a schematic graph of illustrative pulses produced from the mud operated pulser.
Figure 2A:
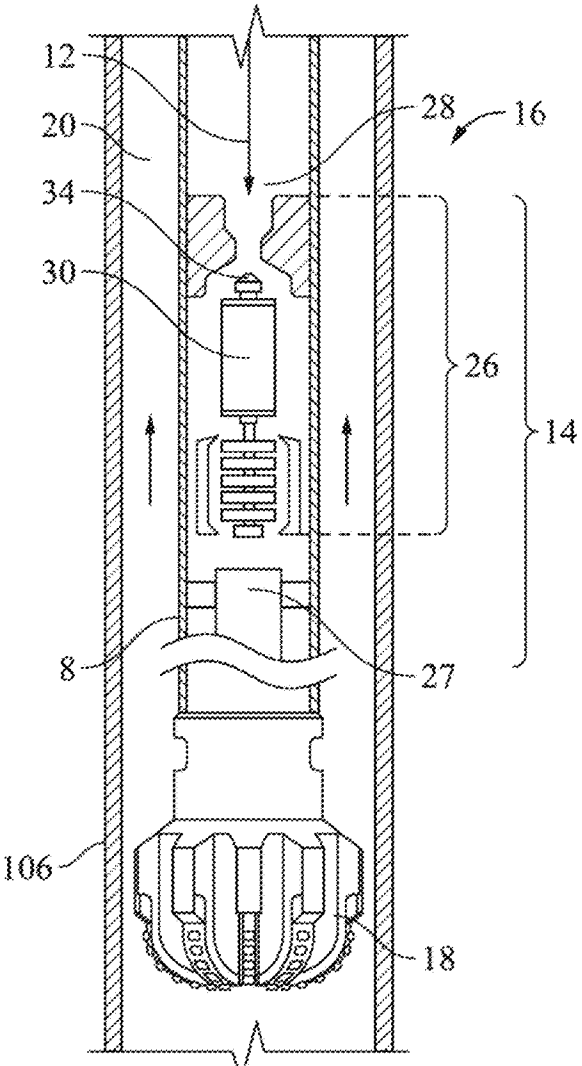
FIG. 2A (Prior Art)
FIG. 2A is a schematic cross-sectional diagram of a typical operation of a positive pulse mud operated pulser of the downhole telemetry tool.
Figure 10A:
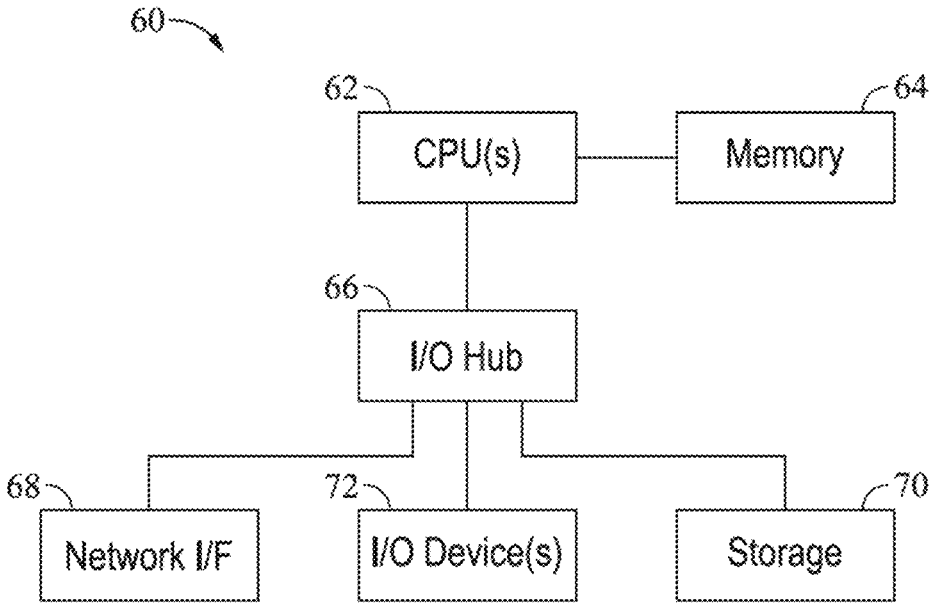
FIG. 10A is a schematic diagram of an example of an encoder having information processing components for processing the pulse information that is communicated to a decoder according to the invention.

FIG. 10A is a schematic diagram of an example of an encoder having information processing components for processing the pulse information that is communicated to a decoder according to the invention. The encoder 60 can be similar to the encoder 27 that is schematically illustrated in FIG. 1 and FIG. 2A, but configured to perform according to the invention herein. The encoder 60 can include, for example, one or more general purpose processors or central processing units (CPUs) 62 communicatively coupled to a memory resource 64 and to an input/output hub 66 to which various I/O resources and/or components are communicatively coupled. The I/O resources can include an communication interface 68, storage resources 70, and additional I/O devices (including components or resources) 72 including as non-limiting examples, remotely interfacing keyboards, mice, displays, printers, and so forth.

Figure 10B:
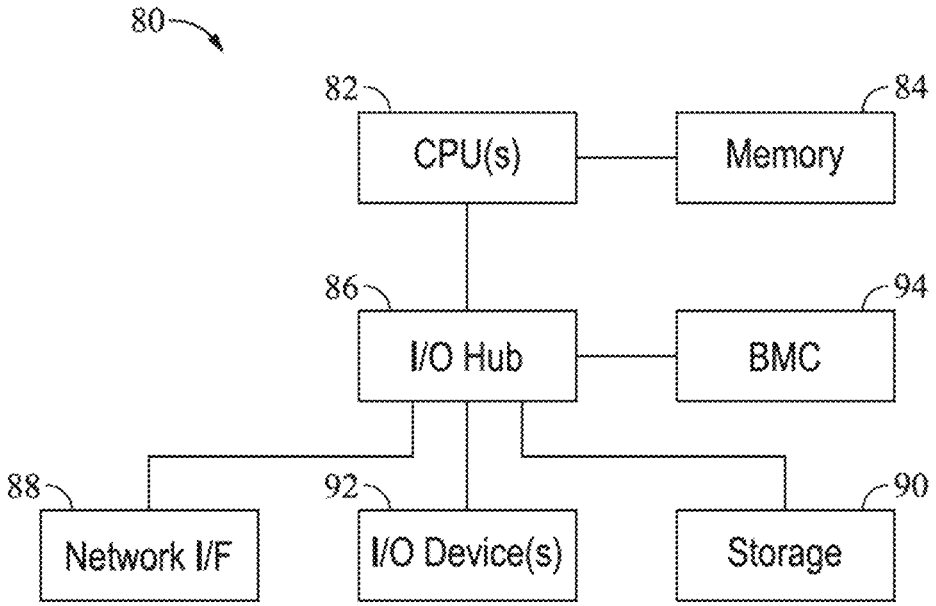
FIG. 10B can also represent a schematic diagram of an example of a decoder having information processing components for processing the pulse information that is communicated from the encoder according to the invention.

FIG. 10B can also represent a schematic diagram of an example of a decoder having information processing components for processing the pulse information that is communicated from the encoder according to the invention. The decoder 80 can be similar to the decoder 25 schematically illustrated in FIG. 1 and FIG. 2A, but configured to perform according to the invention herein. The decoder 80 can include, for example, one or more general purpose processors or central processing units (CPUs) 82 communicatively coupled to a memory resource 84 and to an input/output hub 86 to which various I/O resources and/or components are communicatively coupled. The I/O resources can include an interface 88, such as a network interface, commonly referred to as a NIC (network interface card), storage resources 90, and additional I/O devices 92 (including components or resources) including as non-limiting examples, local or remotely interfacing keyboards, mice, displays, printers, and so forth. The illustrated decoder 80 can include a BMC 94. In at least some embodiments, the BMC 94 may manage the decoder 80 even when the decoder is powered off or powered to a standby state. BMC 94 may include a processor, memory, and/or other embedded information handling resources. In certain embodiments, BMC 94 may include or may be an integral part of a remote access controller or a chassis management controller.

Other and further embodiments utilizing one or more aspects of the inventions described above can be devised without departing from the disclosed invention as defined in the claims. For example, a similar skip methodology could be implemented for the consecutive frames of the combination of 8-slot and 12-slot symbol-frames, and any other number of slot symbol-frames. The pulse width can be vary from the illustrated 4-slot wide pulses from one slot to several slots. The chosen symbols can be varied from the illustrated codes herein, and will generally being synchronized between the encoder and the decoder for actuate decoding. The number of consecutive symbol-frames considered in conjunction with each other to determine the code set of the multiple symbol-frame coding and decoding can vary. Further, different applications other than MLWD can benefit from the skip methodology of the invention. Other variations than those specifically disclosed herein are within the scope of the claims.

The invention has been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicant, but rather, in conformity with the patent laws, Applicant intend to protect fully all such modifications and improvements that come within the scope of the following claims.

What is claimed is:

1. A method of telemetry pulse modulation for communicating information, comprising:

determining if a number of symbol-frame slots between a first pulse, having a position in a first symbol-frame that establishes a first original code, and a second pulse, having a position in a second symbol-frame that is consecutive to the first symbol-frame and that establishes a second original code, is less than a prescribed threshold of symbol-frame slots, and if the number is less than the prescribed threshold, then altering one or more of the original codes to establish one or more predetermined altered codes;

encoding the predetermined altered codes and any remaining original codes;

transmitting the pulses according to codes to a decoder; and decoding the transmitted pulses into the predetermined altered codes and converting the predetermined altered codes into the original codes and together with any unaltered original codes and communicating the original codes containing the information.

2. The method of claim 1, further comprising:

encoding the first original code of the first symbol-frame;

altering the second original code to a second predetermined altered code;

encoding the second predetermined altered code;

transmitting the encoded first original code and encoded predetermined altered code to the decoder;

decoding the first original code; and decoding the second predetermined altered code to establish the second original code based on the first original code and communicating the original codes.

3. The method of claim 2, wherein the second predetermined altered code is a skip code.

4. The method of claim 1, further comprising:

encoding the second original code of the second symbol-frame;

altering the first original code to a first predetermined altered code;

encoding the first predetermined altered code;

transmitting the first encoded first predetermined altered code and encoded second original code to the decoder; and decoding the first predetermined altered code to establish the first original code based on the second original code and communicating the original codes.

5. The method of claim 4, wherein the first predetermined altered code is a skip code.

6. The method of claim 1, further comprising if a previous symbol code is zero of a previous symbol-frame preceding the first symbol frame, then:

encoding the first original code and the second original code with a skip code to form a first predetermined altered code and a second predetermined altered code;

transmitting the previous symbol code, first predetermined altered code, and second predetermined altered code to a decoder; and decoding the previous symbol code, first predetermined altered code, and second predetermined altered code to establish the first and second original codes and communicating the original codes.

7. The method of claim 1, further comprising if a previous symbol code has a non-zero value of a previous symbol-frame preceding the first symbol frame, then:

encoding the first original code and the second original code to form a first predetermined altered code and a second predetermined altered code;

transmitting the first predetermined altered code and second predetermined altered code to a decoder; and decoding the first predetermined altered code and second predetermined altered code to establish the first and second original codes and communicating the original codes.

8. The method of claim 1, further comprising if a previous symbol code is zero of a previous symbol-frame preceding the first symbol frame, then:

encoding at least one of the first original code and the second original code with a skip code to form at least one predetermined altered code defining at least one symbol code for the at least one of the first and second original codes;

transmitting the skip code and any remaining original code; and decoding the skip code and any remaining original code and communicating the original codes.

9. The method of claim 1, wherein altering one or more of the original codes to establish one or more predetermined altered codes is based on a database.

10. The method of claim 1, altering one or more of the original codes to establish one or more predetermined altered codes is based on the number of symbol-frame slots between the pulses.

11. The method of claim 1, further comprising initially determining a pulse width in the number of symbol-frame slots for the pulses.

12. The method of claim 1, further comprising initially determining a minimum number of symbol-frame slots between consecutive pulses in consecutive symbol-frames.

13. The method of claim 1, wherein if the number is not less than the prescribed threshold, then:

encoding the original codes;

transmitting the pulses corresponding to codes to a decoder; and decoding the transmitted pulses into the original codes.

14. The method of claim 1, wherein the codes contain data.

15. The method of claim 1, wherein at least one of the predetermined altered codes is a skip code.

16. A system for telemetry pulse modulation containing information, comprising:

an encoder having an encoding processor and a computer readable memory including processor executable instructions that, when executed by the encoding processor, cause the system to perform encoding operations, and a decoder having a decoding processor and a computer readable memory including processor executable instructions that, when executed by the decoding processor, cause the system to perform decoding operations comprising:

determining if a number of symbol-frame slots between a first pulse having a position in a first symbol-frame and that establishes a first original code, and a second pulse having a position in a second symbol-frame that is consecutive to the first symbol-frame and that establishes a second original code, is less than a prescribed threshold of symbol-frame slots, and if the number is less than the prescribed threshold, then:

altering one or more of the original codes to establish one or more predetermined altered codes;

encoding the predetermined altered codes and any remaining original codes;

transmitting the pulses according to codes to a decoder; and decoding the transmitted pulses into the predetermined altered codes and converting the predetermined altered codes into the original codes and together with any unaltered original codes and communicating the original codes containing the information.

17. The system of claim 16, wherein the executable instructions of the encoding processor and the decoding processor further cause the system to perform encoding and decoding operations comprising:

encoding the first original code of the first symbol-frame;

altering the second original code to a second predetermined altered code;

encoding the second predetermined altered code;

transmitting the encoded first original code and encoded second predetermined altered code to the decoder; and decoding the first original code and the second predetermined altered code to establish the second original code based on the first original code and communicating the original codes.

18. The system of claim 16, wherein the executable instructions of the encoding processor and the decoding processor further cause the system to perform encoding and decoding operations comprising:

encoding the second original code of the second symbol-frame;

altering the first original code to a first predetermined altered code;

encoding the first predetermined altered code;

transmitting the encoded first predetermined altered code and encoded second original code to the decoder; and decoding the first predetermined altered code to establish the first original code based on the second original code and communicating the original codes.

19. The system of claim 16, wherein, if a previous symbol code is zero of a previous symbol-frame preceding the first symbol frame, the executable instructions of the encoding processor and the decoding processor further cause the system to perform encoding and decoding operations, comprising:

encoding the first original code and the second original code with a skip code to form a first predetermined altered code and a second predetermined altered code;

transmitting the previous symbol code, first predetermined altered code, and second predetermined altered code to a decoder; and decoding the previous symbol code, first predetermined altered code, and second predetermined altered code to establish the first and second original codes and communicating the original codes.

20. The system of claim 16, wherein, if a previous symbol code has a non-zero value of a previous symbol-frame preceding the first symbol frame, then the executable instructions of the encoding processor and the decoding processor further cause the system to perform encoding and decoding operations, comprising:

encoding the first original code and the second original code to form a first predetermined altered code and a second predetermined altered code;

transmitting the first predetermined altered code and second predetermined altered code to a decoder;

decoding the first predetermined altered code and second predetermined altered code to establish the first and second original codes and communicating the original codes.

21. The system of claim 16, wherein, if a previous symbol code is zero of a previous symbol-frame preceding the first symbol frame, the executable instructions of the encoding processor and the decoding processor further cause the system to perform encoding and decoding operations comprising:

encoding at least one of the first original code and the second original code with a skip code to form at least one predetermined altered code defining at least one symbol code for the at least one of the first and second original codes;

transmitting the original code and the skip code; and decoding the original code and the skip code and communicating the original codes.

22. The system of claim 16, wherein if the number is not less than the prescribed threshold, then:

encoding the original codes;

transmitting the pulses corresponding to codes to a decoder; and decoding the transmitted pulses into the original codes.

* * * * *